US009428293B2

(12) United States Patent
Yokota et al.

(10) Patent No.: US 9,428,293 B2
(45) Date of Patent: Aug. 30, 2016

(54) BOX PACKING DEVICE

(71) Applicant: ISHIDA CO., LTD., Kyoto-shi, Kyoto (JP)

(72) Inventors: Yuji Yokota, Ritto (JP); Atsushi Takahashi, Ritto (JP); Hiroaki Tokura, Ritto (JP); Takeshi Noguchi, Ritto (JP); Seisaku Iwasa, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 0 days.

(21) Appl. No.: 14/429,528

(22) PCT Filed: Jul. 22, 2013

(86) PCT No.: PCT/JP2013/069749
§ 371 (c)(1),
(2) Date: Mar. 19, 2015

(87) PCT Pub. No.: WO2014/045702
PCT Pub. Date: Mar. 27, 2014

(65) Prior Publication Data

US 2015/0232217 A1 Aug. 20, 2015

(30) Foreign Application Priority Data

Sep. 20, 2012 (JP) ..... 2012-207180

(51) Int. Cl.
*B65B 43/42* (2006.01)
*B65B 43/54* (2006.01)

(52) U.S. Cl.
CPC ..... *B65B 43/54* (2013.01); *B65B 43/42* (2013.01)

(58) Field of Classification Search
CPC ..... B65B 35/20; B65B 35/205; B65B 43/42; B65B 43/46; B65B 43/54; B65B 7/20; B65B 7/26; B65D 2251/04; B65D 2303/00
USPC ..... 53/250, 251, 367, 376.3, 376.4, 377.2, 53/377.3, 377.6, 491
See application file for complete search history.

(56) References Cited

U.S. PATENT DOCUMENTS

| | | | |
|---|---|---|---|
| 3,941,037 A | 3/1976 | Reichert | |
| 4,633,653 A | 1/1987 | Roberts et al. | |
| 5,732,536 A | 3/1998 | Lin et al. | |
| 6,430,895 B1 * | 8/2002 | Kitagawa | B65B 35/22 53/247 |

FOREIGN PATENT DOCUMENTS

| | | |
|---|---|---|
| DE | 102008010432 A1 | 8/2009 |
| JP | 2980120 B1 | 11/1999 |

(Continued)

OTHER PUBLICATIONS

Extended European Search Report of the corresponding European Application No. 1338887.1, dated Mar. 23, 2016.

*Primary Examiner* — Michael McCullough
*Assistant Examiner* — Brendan Tighe
(74) *Attorney, Agent, or Firm* — Global IP Counselors, LLP

(57) ABSTRACT

A box packing device includes a dropping part configured to drops a laterally opened cardboard box in the state in which the lateral flaps of the cardboard box are open before and after dropping. The dropping part has an upper guide mechanism and a lower guide mechanism. The upper guide mechanism includes first upper guide portions that oppose front faces of the flaps and second upper guide portions that oppose rear faces of the flaps. The lower guide mechanism includes a first lower movable guide portion and a first lower fixed guide portion that oppose the front faces of the flaps, second lower guide portions that oppose the rear faces of the flaps, and a first drive unit for driving the second lower guide portions towards the first lower guide portion.

12 Claims, 11 Drawing Sheets

(56) References Cited

FOREIGN PATENT DOCUMENTS

| | | | | |
|---|---|---|---|---|
| JP | 2000-085716 | A | 3/2000 | |
| JP | 2000-185712 | A | 7/2000 | |
| JP | 2004-155428 | A | 6/2004 | |
| JP | 2006-232334 | A | 9/2006 | |
| JP | 2007-290751 | A | 11/2007 | |
| WO | WO 2011119563 | A2 * | 9/2011 | ..... B31B 1/00 |

* cited by examiner

BOX PACKING DEVICE

CROSS-REFERENCE TO RELATED APPLICATIONS

This U.S. National stage application claims priority under 35 U.S.C. §119(a) to Japanese Patent Application No. 2012-207180, filed in Japan on Sep. 20, 2012, the entire contents of which are hereby incorporated herein by reference.

TECHNICAL FIELD

The present invention relates to a box packing device.

BACKGROUND ART

As disclosed in patent document 1 (Japanese Laid-open Patent Application No. 2004-155428), box packing devices that pack articles from a horizontal direction into a horizontally opened cardboard box are known. In the device disclosed in patent document 1, a horizontally opened cardboard box is carried in a horizontal direction and is then transported by a conveyor in the vertical direction to a box packing mechanism that packs articles into the cardboard box.

However, this configuration requires installation of a conveyor for transporting the cardboard boxes in the vertical direction. Further, vertical transportation of the cardboard box to the box packing mechanism is time-consuming.

In response to these issues, the inventor of the present invention conceives that the conveyor for vertically transporting the cardboard box can be eliminated and swift vertical transportation of the cardboard box can be achieved by dropping the horizontally opened cardboard box.

This configuration requires a guide member for maintaining the posture of the cardboard box appropriately while the cardboard box is dropping and after the cardboard box has dropped and for restricting a movement of the lid of the cardboard box in the horizontal direction to prevent the lid from closing.

SUMMARY OF THE INVENTION

Technical Problem

However, if the movement of the lid of the cardboard box in the horizontal direction is strongly restricted by the guide member, the lid of the cardboard box may be caught by the guide member when the cardboard box drops. On the other hand, if the movement of the lid of the cardboard box in the horizontal direction is insufficiently restricted by the guide member, the cardboard box will move easily and thereby the processes, such as packing the articles or the like, to be performed after the box drops may be negatively affected.

A purpose of the present invention is to provide a highly reliable box packing device that moves a horizontally opened cardboard downward by dropping it, which can drop the cardboard box without obstacle while maintaining the cardboard box in an appropriate posture after the cardboard box has dropped.

Solution to the Problem

A box packing device according to an aspect of the present invention is provided with a dropping part for dropping a box to change the height position of the box. The box has a rectangular or surrounding shaped side face portion having four side faces and four tabular lid portions each extending from one of the side faces. The dropping part positions one of the side faces of the four side faces to the bottom and drops the box in a state that an upper lid portion extending from the upper side face among the four lid portions and first and second lateral lid portions extending from the laterally positioned side faces among the four lid portions are opened outward. The dropping part has an upper guide mechanism and a lower guide mechanism arranged below the upper guide mechanism. The upper guide mechanism includes a first guide portion arranged so as to oppose the front faces of the first and second lateral lid portions when the box drops and a second guide portion arranged so as to oppose the rear faces of the first and second lateral lid portions when the box drops. The lower guide mechanism includes a third guide portion arranged so as to oppose the front faces of the first and second lateral lid portions when the box drops and after the box drops, a fourth guide portion arranged so as to oppose the rear faces of the first and second lateral lid portions when the box drops and after the box drops, and a first drive unit that drives at least either of the third guide portions or the fourth guide portions toward the other after the box drops.

Since it is possible to alter the distance between the third guide portions and fourth guide portions of the lower guide mechanism, the passage through which the lateral lid portions pass can be kept wide open until the box drops, and after the box drops, movement of the lateral lid portions can be highly restricted such that the box is kept in the appropriate posture and position. A highly reliable box packing device is thereby provided.

Further, it is preferable in the box packing device according to the present invention, that the third guide portion and the fourth guide portion are arranged such that, when the box drops, the minimum distance between the third guide portion and the fourth guide portion is equal to or greater than the minimum distance between the first guide portion and the second guide portion. It is preferable that the third guide portion is arranged forward of the first guide portion and the fourth guide portion is arranged rearward of the first guide portion.

Since the passage for the lateral lid portions in the lower guide mechanism is wide open until the box has dropped, the lateral lid portions are hardly caught by the lower guide mechanism when the box drops. A highly reliable box packing device is thereby provided.

Moreover, it is preferable in the box packing device according to the present invention, that the upper guide mechanism includes at least either of the first guide portion having a first guide plane that opposes the front faces of the first and second lateral lid portions when the box drops or the second guide portions having a second guide plane that opposes the rear faces of the first and second lateral lid portions when the box drops. It is preferable that the lower guide mechanism includes at least either of third guide portion having a third guide plane that opposes the front faces of the first and second lateral lid portions when the box drops and after the box drops or the fourth guide portion having a fourth guide plane that opposes the rear faces of the first and second lateral lid portions when the box drops and after the box drops.

Since at least either the front faces or the rear faces of the first and second lateral lid portions are guided by the plane in the upper guide mechanism and the lower guide mechanism, movement of the lid portions can be highly restricted.

Resultantly, the box can be maintained in the appropriate posture and position, and a highly reliable box packing device is provided.

Further, in the box packing device according to the present invention, it is preferable that, at the point in time when the first drive unit completes driving, the third guide portion opposes the front faces of the first and second lateral lid portions in the vicinity of a boundary between the first and second lateral lid portions and the side face portion. Moreover it is preferable that, at the point in time when the first drive unit completes driving, the fourth guide portion opposes the rear faces of the first and second lateral lid portions in the vicinity of a boundary between the first and second lateral lid portions and the side face portion.

Since the third and fourth guide portions restrict movement of the lid portions in the vicinity of the boundary between the side face portion and the lid portions (in the vicinity of the area at the base of the lid portions), movement of the box can be more stringently restricted in comparison to the case that movement of the lid portions is restricted by opposing the end parts of the side face portion.

Moreover, in the box packing device according to the present invention, it is preferable that the third guide portion further opposes a front face of the upper lid portion.

In this way the upper lid portion is prevented from falling forward and closing the opening of the box.

Further, in the box packing device according to the present invention, it is preferable that the third guide portion includes a fixed guide portion that opposes the front face of the first lateral lid portion and a movable guide portion that opposes the front face of the second lateral lid portion and the front face of the upper lid portion. It is preferable that the movable guide portion opposes at least a center part of the front face of the upper lid portion when the box drops. It is preferable that the lower guide mechanism further includes a second drive unit for driving the movable guide portion in parallel to the front face of the upper lid portion after the box drops. It is preferable that the second drive unit drives the movable guide portion to a position where the movable guide portion opposes the front face of the upper lid portion only at the end part of the second lateral lid portion side after the box drops.

Here, one of the third guide portions is a movable guide portion, and the movable guide portion opposes at least the center part of the front face of the upper lid portion when the box drops, while after the box has dropped, the movable guide portion opposes only the end part of the front face of the upper lid portion. Thus, the movable guide portion can easily prevent that the upper lid portion falls forward when the box drops. After the box drops, the opening of the box can be kept open wide while forward falling of the upper lid portion is being prevented by the movable guide portion.

Further, in the box packing device according to the present invention, it is preferable that the first drive unit drives at least either of the third guide portion or the fourth guide portion so that at least either of the third guide portion or the fourth guide portion come into contact with the first and second lateral lid portions thereby to move the box horizontally.

In this way, the box can be moved horizontally to the desired position by the first drive unit.

Effects of the Invention

The box packing device according to the present invention has a dropping part that drops a box to change the height position of the box where the width of the passage through which the lateral lid portions of the box pass can be kept wide open until the box drops, and after the box drops, movement of the lateral lid portions can be restricted such that the box is kept in the appropriate posture and position. Resultantly, a highly reliable box packing device is provided.

BRIEF DESCRIPTION OF THE DRAWINGS

FIG. 8(*a*) provides the view showing the vicinity of the lower guide mechanism immediately after the cardboard box drops; FIG. 8(*b*) provides the view showing the vicinity of the lower guide mechanism when a horizontal movement (forward movement) operation of the second lower guide portion driven by the first drive unit has completed; FIG. 8(*c*) provides the view showing the vicinity of the lower guide mechanism when height position adjustment by the position and orientation changing part has completed (at the time when the cardboard box has moved to the position where articles are pushed therein);

FIG. 9(*a*) provides the view showing the vicinity of the lower guide mechanism immediately after the cardboard box drops; FIG. 9(*b*) provides the view showing the vicinity of the lower guide mechanism when a horizontal movement (forward movement) operation of the second lower guide portion driven by the first drive unit has completed; FIG. 9(*c*) provides the view showing the vicinity of the lower guide mechanism when height position adjustment by the position and orientation changing part has completed (at the time when the cardboard box has moved to the position where articles are pushed therein);

DESCRIPTION OF EMBODIMENTS

An embodiment of the present invention will now be described with reference to the drawings. The embodiment described below is an example that is illustrative and is not intended to restrict the technical scope of the invention.

(1) Overall Configuration

Figure 1:
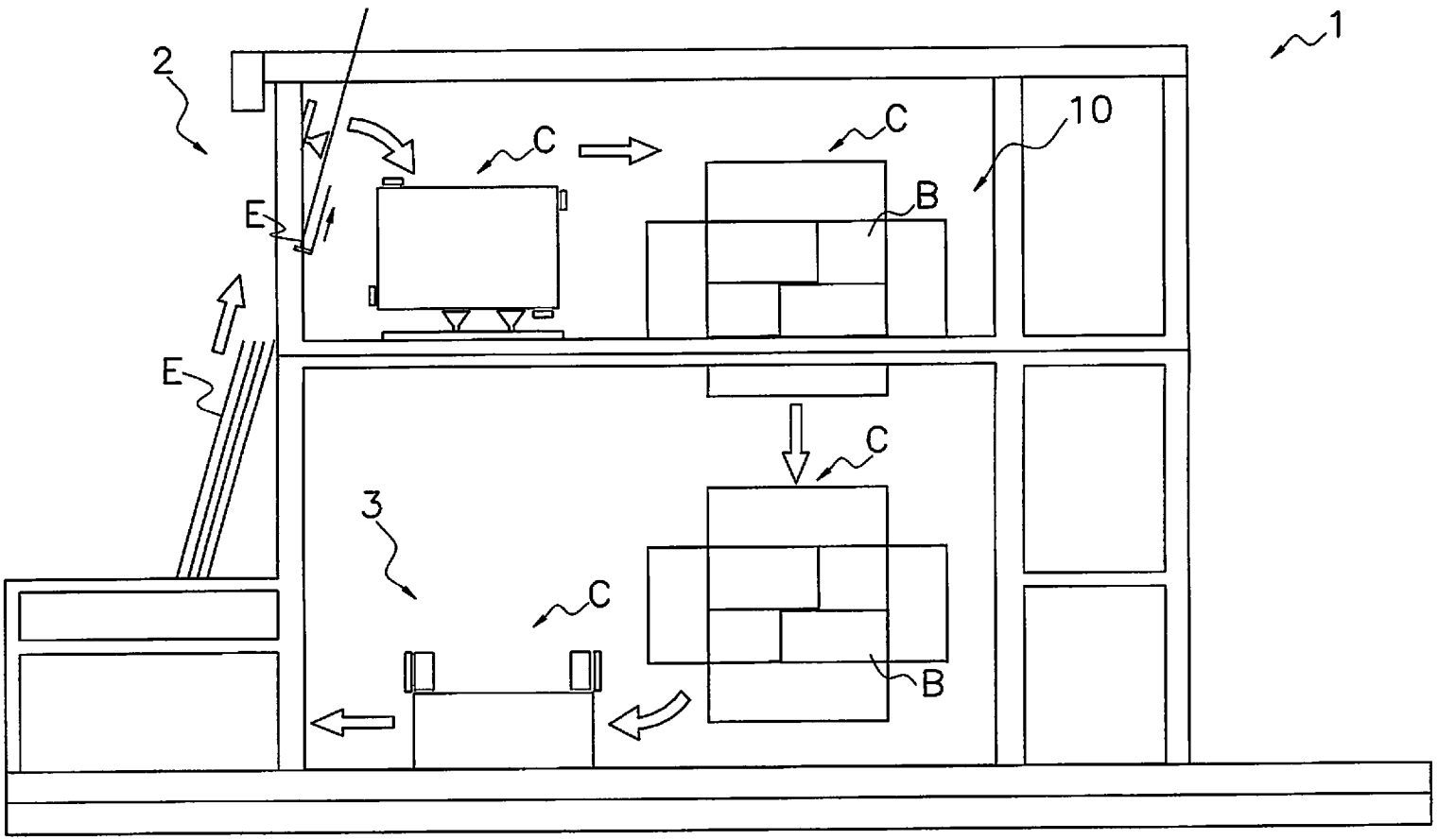
FIG. 1 is a schematic side view of a box making/box packing system including the box packing device according to an embodiment of the present invention. This figure shows the box making/box packing system viewing from the rear side of the box packing device (the bottom lid side of the cardboard box)

FIG. 1 is a side view of a box making/box packing system 1 including a box packing device 10 according to an embodiment of the present invention.

The box making/box packing system 1 will now be described. Note that terms such as upper, lower, top, bottom, upward, downward, left, right, forward and backward are used in order to describe directionality, unless stated otherwise, according to the direction shown in FIG. 5.

The box making/box packing system 1 includes a box making device 2, a box packing device 10 and a box closing device 3.

The box making device 2 opens out a cardboard sheet E (FIG. 1) being a cardboard box C in a folded down state (box opening) and then closes a bottom lid B of the cardboard box C so as to make the cardboard box C which is open only at one end (at the upper lid side). The cardboard box C made by the box making device 2 is then transported to the box packing device 10 by a conveyor not shown in the drawing.

The box packing device 10 is supplied with the cardboard box C being in a laterally opened state by the conveyor not shown in the drawing. More specifically, the cardboard box C in which the bottom lid B is placed at the rear side and the opening is placed at the front side is transported by the conveyor and supplied to the box packing device 10.

Figure 2:
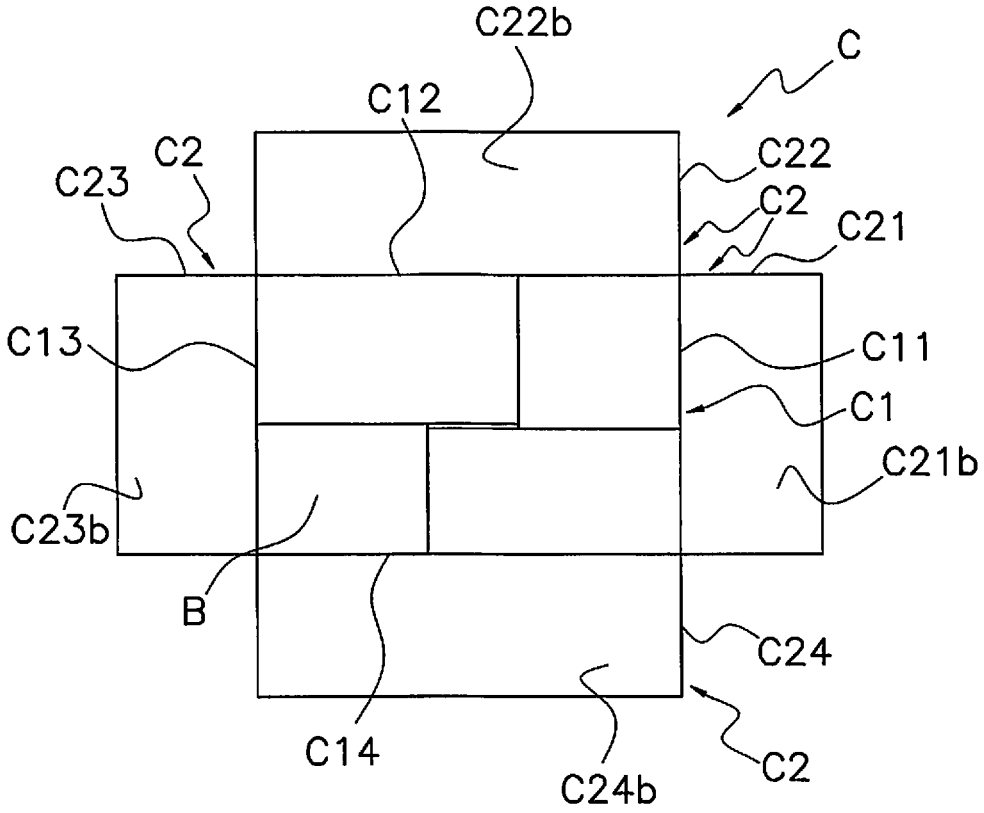
FIG. 2 shows a cardboard box viewing from its bottom lid side which is used for packing articles in the box packing device of FIG. 1.
Figure 5:
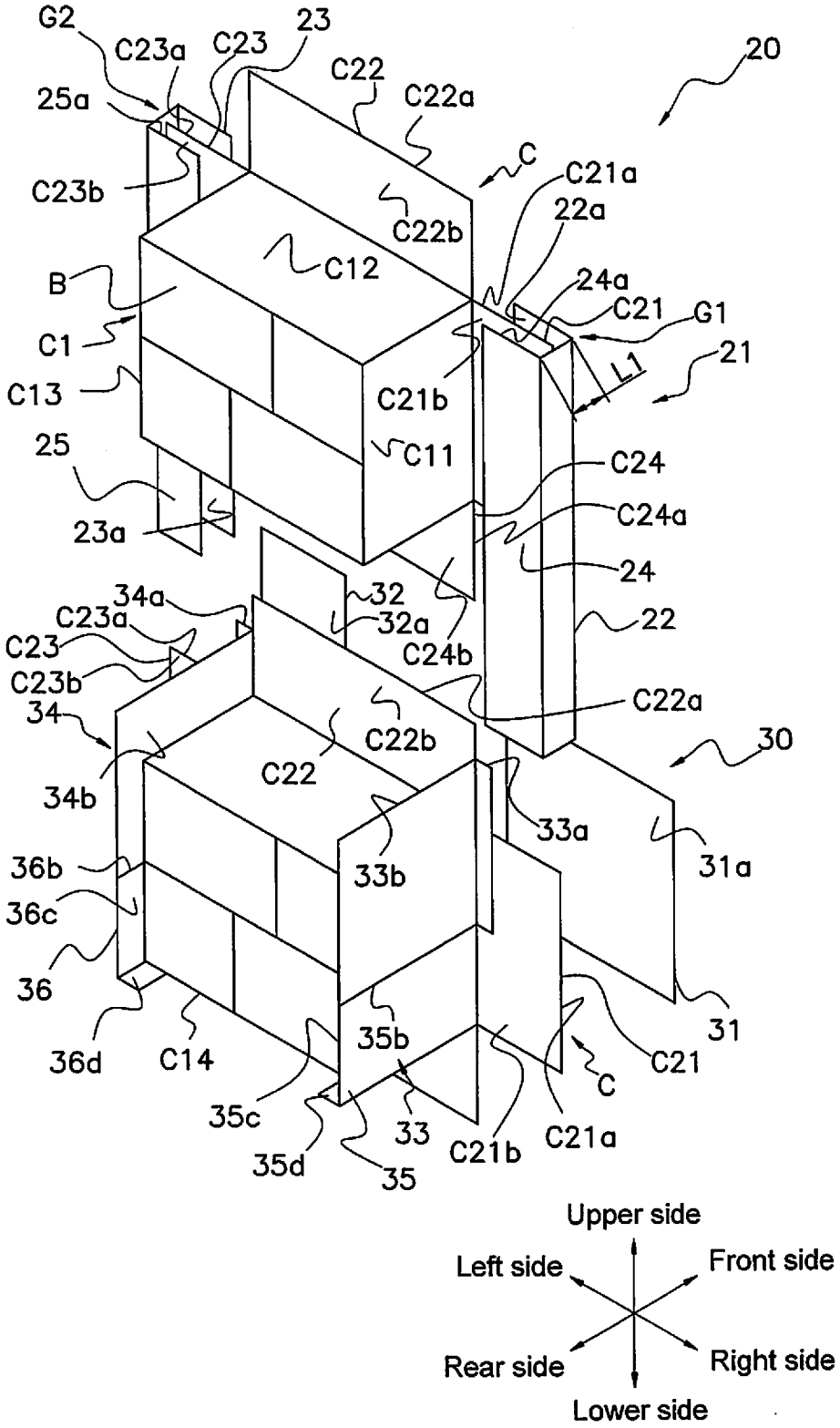
FIG. 5 is a schematic perspective view explaining the dropping part of the box packing device of FIG. 1.

The cardboard box C used by the box making/box packing system 1, as shown in FIG. 2 and FIG. 5, has a rectangular shaped side face portion C1 having four side faces C11-C14, and a total of eight tabular flaps C2 each extending forward or rearward from the four side faces C11-C14. At the time where the cardboard box is supplied to the box packing device 10, the flaps C2 of the bottom lid side (rear side) is closed by the box making device 2 and the bottom lid B is formed. The flaps C21-C24 (C2) of the upper lid side (front side) are opened outwardly. As shown in FIG. 5, the front faces C21*a*-C24*a* of the flaps C21-C24 are arranged at the front side, while the rear faces C21*b*-C24*b* of the flaps C21-C24 are arranged at the rear side. The cardboard box C is supplied to the box packing device 10 in the state in which the side face C14 is directed downward, as shown in FIG. 2.

Figure 3:
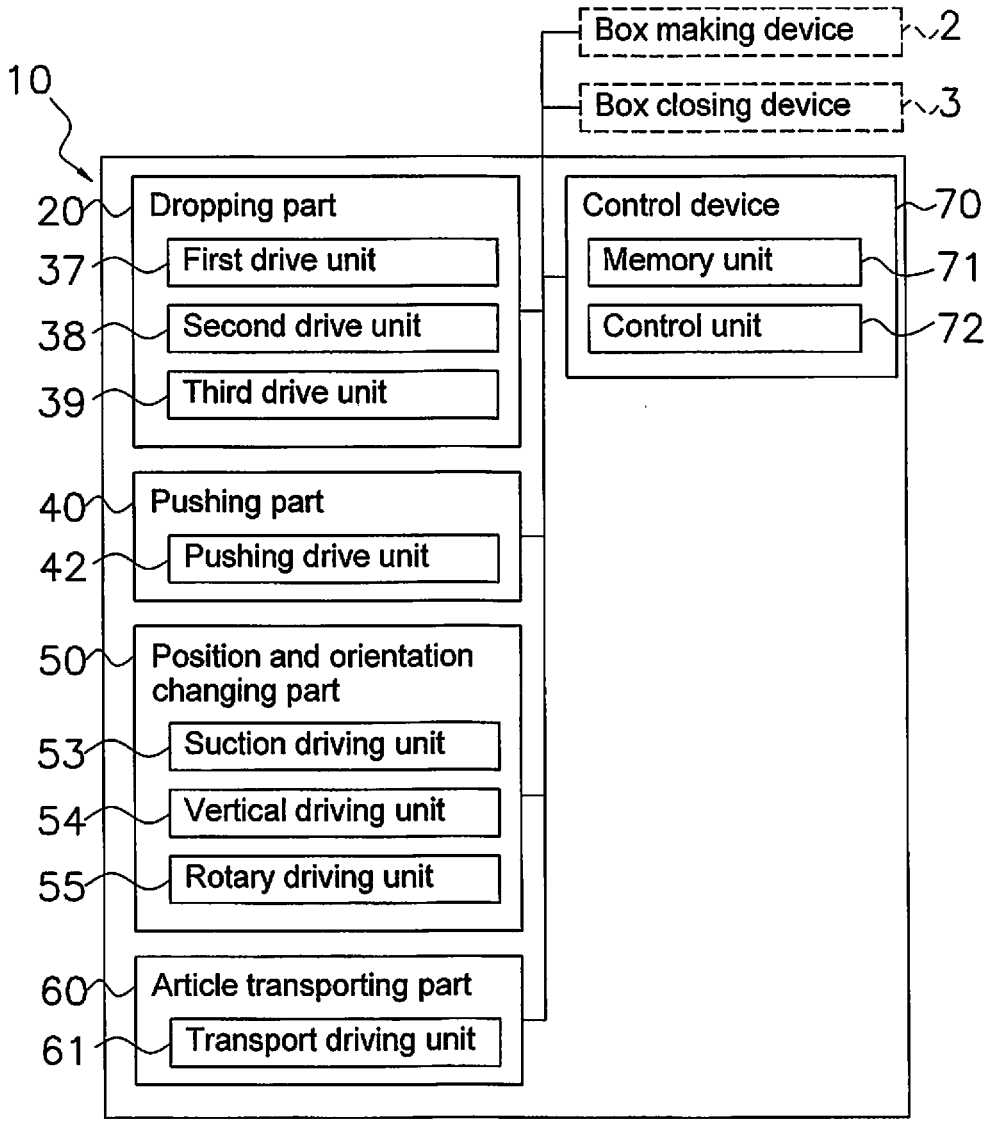
FIG. 3 is a block diagram of the box packing device of FIG. 1.

As shown in FIG. 3, the box packing device 10 is mainly provided with a dropping part 20, a pushing part 40, a position and orientation changing part 50, an article transporting part 60, and a control device 70. The dropping part 20 changes the height position of the cardboard box C by dropping the cardboard box C, being supplied from the box making device 2 via the conveyor, in a state in which the side face C14 is directed downward and the opening is directed forward. The pushing part 40 pushes an article A (the article to be packed) conveyed by the article transporting part 60, from the side (from the front side), into the cardboard box C dropped by the dropping part 20. When the article A is pushed into the cardboard box C by the pushing part 40, the position and orientation changing part 50 adjusts the height position of the cardboard box C. Further, the position and orientation changing part 50 raises the cardboard box C which is open forward and contains the article A, such that the opening of the cardboard box C faces upward. The control device 70 controls the movements of the dropping part 20, the pushing part 40, the position and orientation changing part 50, and the article transporting part 60 and the like. The dropping part 20, the pushing part 40, the position and orientation changing part 50, the article transporting part 60 and the control device 70 are described in detail subsequently.

The cardboard box C raised by the position and orientation changing part 50 such that the opening faces upward is then conveyed by a conveyor not shown in the drawing and supplied to the box closing device 3. The box closing device 3 closes the flaps C2 of the upper lid side (flaps C21-C24) and thereby forms the upper lid. The cardboard box C whose upper lid is closed by the box closing device 3 is conveyed from the box making/box packing system 1 by a conveyor not shown in the drawing.

(2) Detailed Configuration

The dropping part 20, the pushing part 40, the position and orientation changing part 50, the article transporting part 60 and the control device 70 of the box packing device 10 will now be described. Note that, hereinafter, terms such as upper, lower, top, bottom, upward, downward, left, right, forward and backward are used in order to describe directionality, unless stated otherwise, according to the direction shown in FIG. 5.

(2-1) Dropping Part

The dropping part 20 changes the height position of the cardboard box C by dropping the forward opened cardboard box C, being supplied from the box making device 2 via a conveyor, with the side face C14 directed downward. When the cardboard box C drops, the flap C22 extending from the upper side face C12, the flaps C21, C23 extending from the lateral side faces C11, C13, and the flap C24 extending from the lower side face C14 are open outward. In other words, the height position of the cardboard box C is changed by the dropping part 20, in the state where the opening of the cardboard box C is not covered by the flaps C21-C24.

Figure 4:
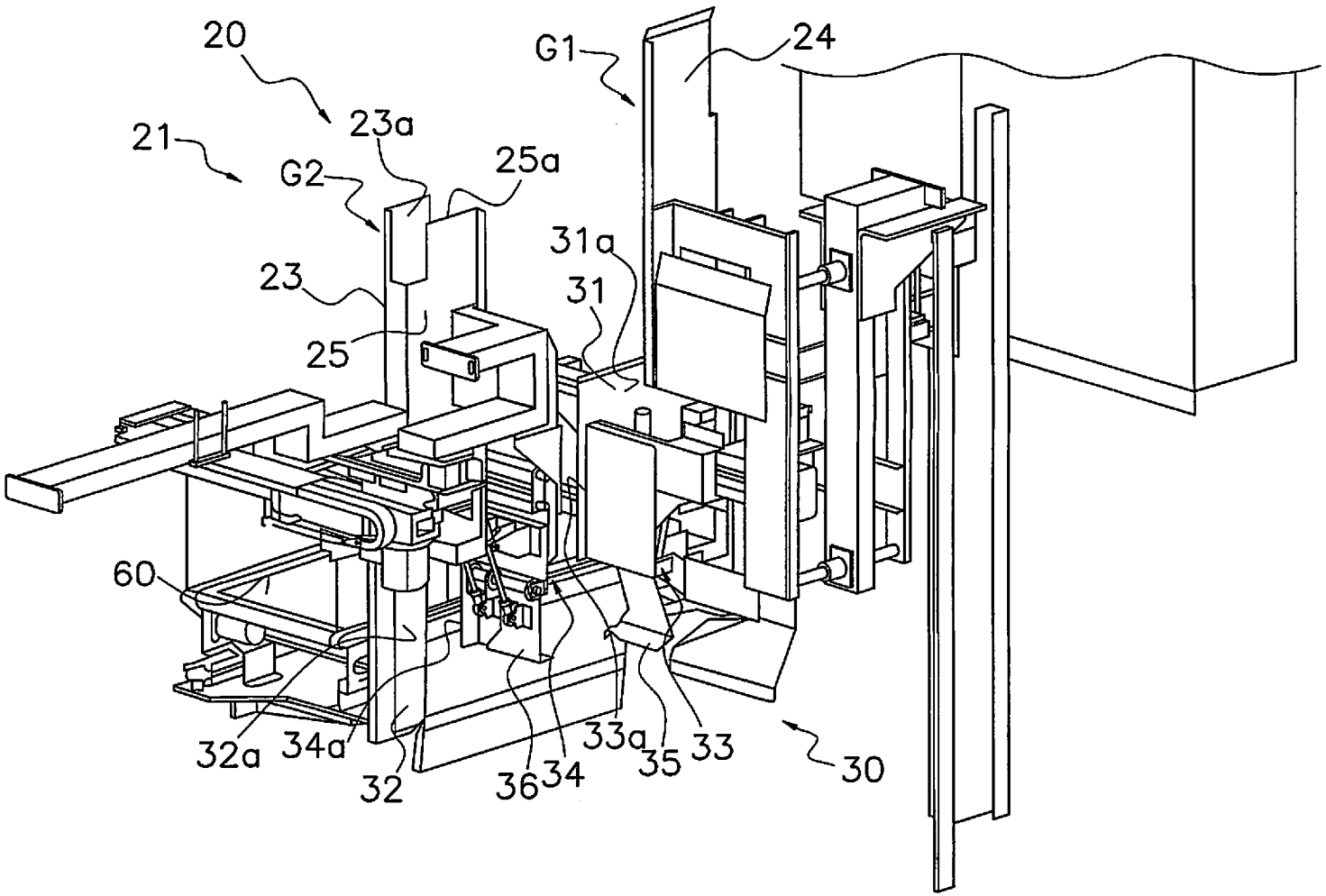
FIG. 4 is a perspective view of the dropping part of the box packing device of FIG. 1.

As shown in FIG. 4 and FIG. 5, the dropping part 20 has an upper guide mechanism 21 and a lower guide mechanism 30.

(2-1-1) Upper Guide Mechanism

The upper guide mechanism 21 restricts movement of the flaps C21, C23 arranged at the lateral sides of the cardboard box C such that those flaps do not close when the cardboard box C drops. As movement of the flaps C21, C23 is restricted by the upper guide mechanism 21, the cardboard box C drops in the predetermined posture and in the predetermined position.

As shown in FIG. 5, the upper guide mechanism 21 includes first upper guide portions 22 and 23 arranged opposing the front faces C21*a* and C23*a* of the flaps C21 and C23 of the dropping cardboard box C and the second upper guide portions 24, 25 arranged opposing the rear faces C21*b*, C23*b* of the flaps C21, C23 of the dropping cardboard box C.

As shown in FIG. 5, the first upper guide portion 22 and the second upper guide portion 24 are arranged so as to be mutually opposed and are formed in a single integrated U-shaped body as the right guide portion G1 restricting movement of the flap C21. As shown in FIG. 5, the first upper guide portion 23 and the second upper guide portion 25 are arranged so as to be mutually opposed and are formed in a single integrated U-shaped body as the left guide portion G2 restricting movement of the flap C23. The right guide portion G1 and the left guide portion G2 are substantially bilateral symmetrically configured in a top view.

As shown in FIG. 5, when the cardboard box C drops, the flap C21 passes through the right guide portion G1 of substantially U-shaped form, and the flap C23 passes through the left guide portion G2 of substantially U-shaped form. The front face C21*a* and the rear face C21*b* of the flap C21 of the cardboard box C in the process of dropping, oppose the guide plane 22*a* of the first upper guide portion 22 and the guide plane 24*a* of the second upper guide portion 24. The front face C23*a* and the rear face C23*b* of the flap C23 of the cardboard box C in the process of dropping, oppose the guide plane 23*a* of the first upper guide portion 23 and the guide plane 25*a* of the second upper guide portion 25.

The guide plane 22*a* of the first upper guide portion 22 and the guide plane 24*a* of the second upper guide portion 24 are parallel. The guide plane 23*a* of the first upper guide portion 23 and the guide plane 25*a* of the second upper guide portion 25 are parallel. Here, parallel includes being substantially parallel.

The minimum distance between the first upper guide portion 22 and the second upper guide portion 24, that is, the distance L1 between the guide plane 22*a* of the first upper guide portion 22 and the guide plane 24*a* of the second upper guide portion 24 is determined such that the cardboard box C in the process of dropping does not get caught between the first upper guide portion 22 and the second upper guide portion 24. Further, the distance L1 is determined such that horizontal movement of the flap C21 can be restricted to some degree, in order to drop the cardboard box C in the predetermined posture and in the predetermined position. In determining the distance L1, not only unused cardboard boxes C but also used cardboard boxes C (reused boxes) are envisaged to be used by the box packing device 10.

The distance between the guide plane 23*a* of the first upper guide portion 23 and the guide plane 25*a* of the second upper guide portion 25 is substantially the same as the distance L1 between the guide plane 22*a* of the first upper guide portion 22 and the guide plane 24*a* of the second upper guide portion 24.

(2-1-2) Lower Guide Mechanism

The lower guide mechanism 30 functions in the same manner as the upper guide mechanism 21 while the cardboard box C is dropping. That is, the lower guide mechanism 30 restricts movement of the flaps C21, C23 arranged at the lateral sides of the cardboard box C such that these flaps do not close. As movement of the flaps C21, C23 of the cardboard box C in the process of dropping is restricted by the lower guide mechanism 30, the cardboard box C drops in the predetermined posture and in the predetermined position.

Further, after the cardboard box C has dropped, the lower guide mechanism 30 restricts movement of the flaps C21, C23 arranged at the lateral sides of the cardboard box C more strongly than while the cardboard box C is dropping. As movement of the flaps C21, C23 of the cardboard box C that has dropped is tightly restricted by the lower guide mechanism 30, movement of the cardboard box C in the horizontal direction (falling rearward) is restricted when article A is pushed into the cardboard box C.

The lower guide mechanism 30 has a first lower guide including a first lower movable guide portion 31 and a first lower fixed guide portion 32 (refer FIG. 5), second lower guide portions 33, 34 (refer FIG. 5), and a first drive unit 37 (refer FIG. 3) for driving the second lower guide portions 33, 34. Further, the lower guide mechanism 30 has a second drive unit 38 (refer FIG. 3) for driving the first lower movable guide portion 31, and a third drive unit 39 (refer FIG. 3) for driving movable hooks 35, 36 provided to the second lower guide portions 33, 34 described subsequently.

As shown in FIG. 5, the first lower movable guide portion 31 is a plate shaped member arranged opposing the front face C21*a* of the flap C21 of the cardboard box C when the cardboard box C drops and after the cardboard box C drops. The first lower movable guide portion 31 has a guide plane 31*a* that opposes the front face C21*a* of the flap C21. The first lower movable guide portion 31 functions as a pair with the second lower guide portion 33 to restrict movement of the flap C21.

Figure 9:
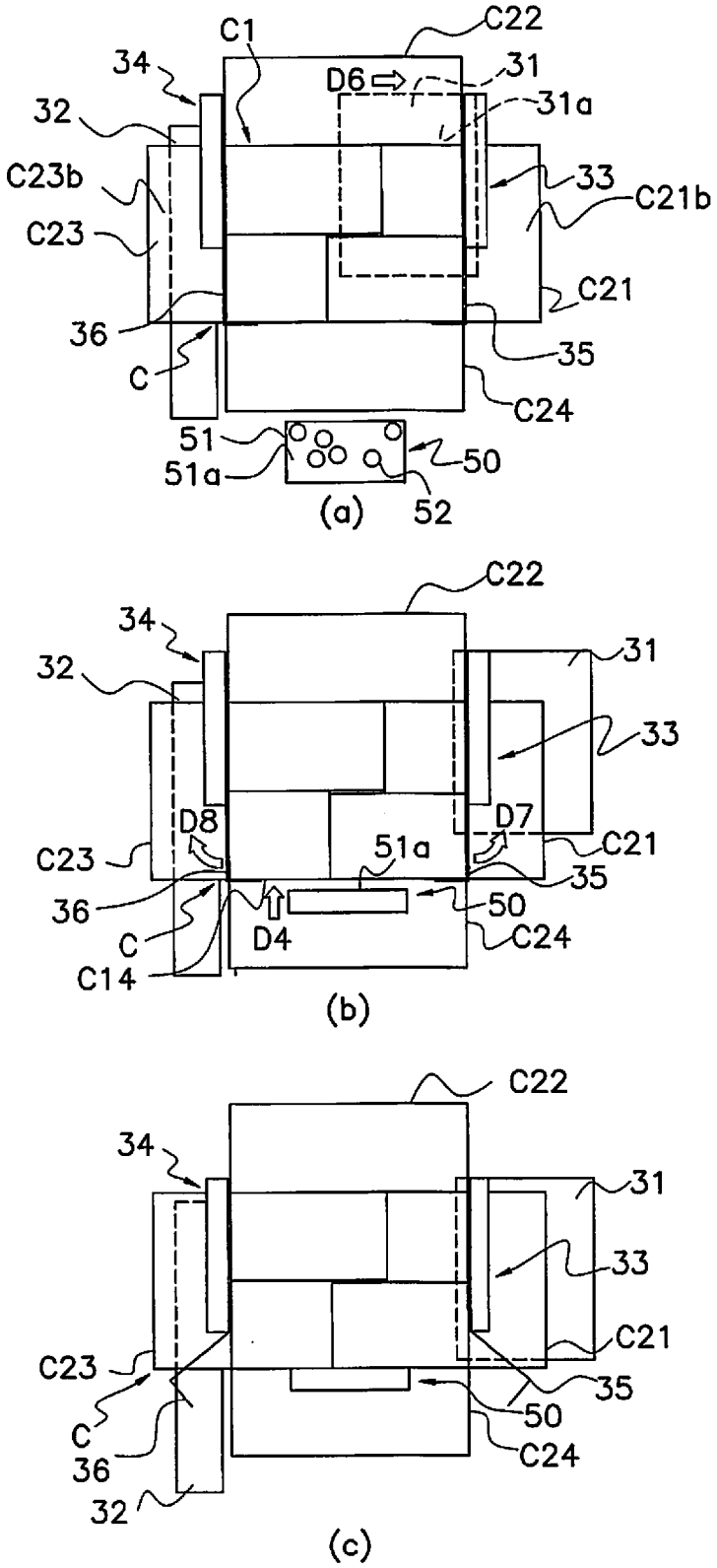
FIG. 9 provides side views, which show the vicinity of the lower guide mechanism viewing from the rear side, explaining the movements of the lower guide mechanism of the box packing device of FIG. 1 and position and orientation changing part.

Moreover, as shown in FIGS. 9(*a*) and 9(*b*), the guide plane 31*a* of the first lower movable guide portion 31 opposes the front face C22*a* of the flap C22 arranged to the upper side of the cardboard box C when the cardboard box C drops and after the cardboard box C drops. That is, the first lower movable guide portion 31 restricts movement of the flap C22 in addition to movement of the flap C21 for preventing the flap C22 from closing (falling forward).

The first lower movable guide portion 31 is driven by the second drive unit 38 in the forward-rearward and the leftward-rightward directions. The movement of the first lower movable guide portion 31 is described subsequently.

As shown in FIG. 5, the first lower fixed guide portion 32 is a plate shaped member arranged opposing the front face C23*a* of the flap C23 of the cardboard box C when the cardboard box C drops and after the cardboard box C drops. The first lower fixed guide portion 32 has a guide plane 32*a* that opposes the front face C23*a* of the flap C23. The first lower fixed guide portion 32 functions as a pair with the second lower guide portion 34 to restrict movement of the flap C23. The first lower fixed guide portion 32 is fixed in position, unlike the first lower movable guide portion 31.

Figure 6:
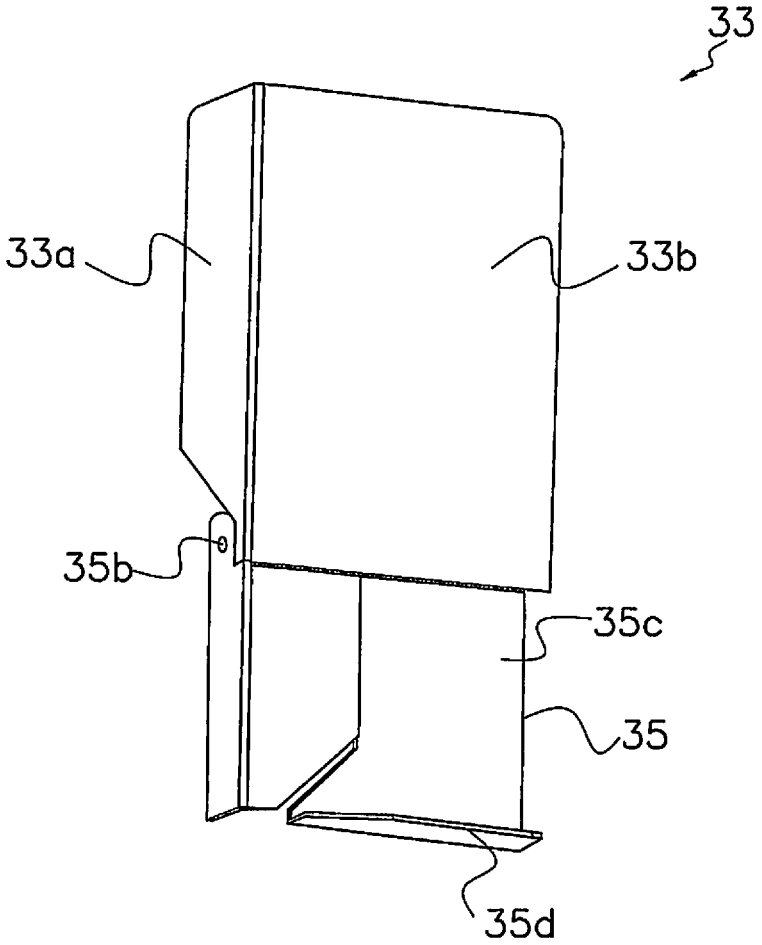
FIG. 6 is a schematic perspective view of the second lower guide portion on the right side, being one of the second lower guide portions of the dropping part shown in FIG. 5.

The second lower guide portion 33 is a member having a substantially L-shaped form in top view. As shown in FIG. 6, the second lower guide portion 33 has a guide plane 33*a* extending in the leftward-rightward direction in FIG. 5 and a lateral guide plane 33*b* extending rearward from the left end of the guide plane 33*a*. The guide plane 33*a* opposes the rear face C21*b* of the flap C21 of the cardboard box C when the cardboard box C drops and after the cardboard box C drops. The lateral guide plane 33*b* opposes the side face portion C1 (side face C11) of the cardboard box C when the cardboard box C drops and after the cardboard box C drops. Further, as shown in FIG. 6, a movable hook 35 is provided to the lower part of the second lower guide portion 33, which is configured to be rotatable around the rotation axis 35*b* extending in the forward-rearward direction in FIG. 5. The movable hook 35 has a side face 35*c* that opposes the side face portion C1 (side face C11) of the cardboard box C when the cardboard box C drops and a protruding portion 35*d* that protrudes from the lower end of the side face 35*c* to the left in FIG. 5. The protruding portion 35*d* catches the side face C14 of the cardboard box C when the cardboard box C drops.

Figure 7:
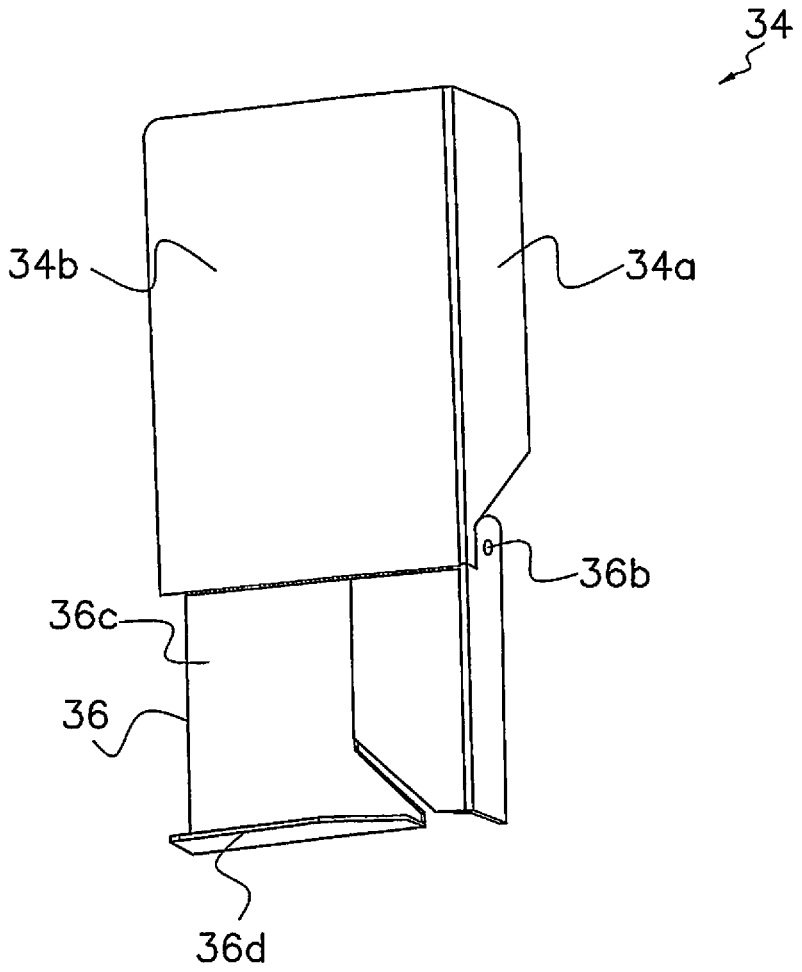
FIG. 7 is a schematic perspective view of the second lower guide portion on the left side, being one of the second lower guide portions of the dropping part shown in FIG. 5.

The second lower guide portion 34 is a member having a substantially L-shaped form in top view. As shown in FIG. 7, the second lower guide portion 34 has a guide plane 34*a* extending in the leftward-rightward direction in FIG. 5 and a lateral guide plane 34*b* extending rearward from the right end of the guide plane 34*a*. The guide plane 34*a* opposes the rear face C23*b* of the flap C23 of the cardboard box C when the cardboard box C drops and after the cardboard box C drops. The lateral guide plane 34*b* opposes the side face portion C1 (side face C13) of the cardboard box C when the cardboard box C drops and after the cardboard box C drops. Further, as shown in FIG. 7, a movable hook 36 is provided to the lower part of the second lower guide portion 34, which is configured to be rotatable around the rotation axis 36*b* extending in the forward-rearward direction in FIG. 5. The movable hook 36 has a side face 36*c* that opposes the side face portion C1 (side face C13) of the cardboard box C when the cardboard box C drops and a protruding portion 36*d* that protrudes from the lower end of the side face 36*c* to the right in FIG. 5. The protruding portion 36*d* catches the side face C14 of the cardboard box C when the cardboard box C drops.

The second lower guide portions 33, 34 are driven in the forward-rearward direction by the first drive unit 37. The movable hooks 35, 36, are driven by the third drive unit 39, so as to turn either clockwise or anticlockwise viewed from the rear side. The movements of the second lower guide portions 33, 34 and the movable hooks 35, 36 are described subsequently.

The first drive unit 37 is an air cylinder that drives the second lower guide portions 33, 34 in the forward-rearward direction. The first drive unit 37 drives (moves) the second lower guide portion 33 forward so that it approaches the first lower movable guide portion 31 and drives (moves) the second lower guide portion 34 forward so that it approaches the first lower fixed guide portion 32 after the cardboard box C has dropped.

When the first drive unit 37 drives the second lower guide portion 33 and the second lower guide portion 34 forward, the second lower guide portion 33 is brought into contact with the flap C21 and the second lower guide portion 34 is brought into contact with the flap C23 to move the cardboard box C forward in horizontal direction. That is, the first drive unit 37 performs the function of moving the cardboard box C horizontally.

The second drive unit 38 is an air cylinder that drives the first lower movable guide portion 31 in the forward-rearward direction and the leftward-rightward direction. That is, the second drive unit 38 is an air cylinder that drives the first lower movable guide portion 31 in the forward-rearward direction and in the direction parallel to the front face C22*a* of the flap C22 that is in the state of extending perpendicularly from the side face portion C1. Here, parallel direction includes being substantially parallel direction.

The third drive unit 39 is an air cylinder that rotationally drives the movable hooks 35, 36 so as to turn either clockwise or anticlockwise viewed from the rear side.

The first drive unit 37, the second drive unit 38 and the third drive unit 39 are controlled by the control device 70 described subsequently. The operation and the timing of the operation of the second lower guide portions 33, 34, the first lower movable guide portion 31 and the movable hooks 35, 36 with the first drive unit 37, the second drive unit 38 and the third drive unit 39 are described subsequently.

(2-2) Pushing Part

For box packing, the pushing part 40 pushes the article A that has been conveyed by the article transporting part 60 into the cardboard box C which has been moved into the predetermined position for packing articles by the first drive unit 37 and the position and orientation changing part 50 as described subsequently.

The pushing part 40 has a pushing member 41 (refer FIG. 8) arranged so as to oppose the opening of the cardboard box C and a pushing drive unit 42 (refer FIG. 3), to move the pushing member 41 in the forward-rearward direction.

Figure 8:
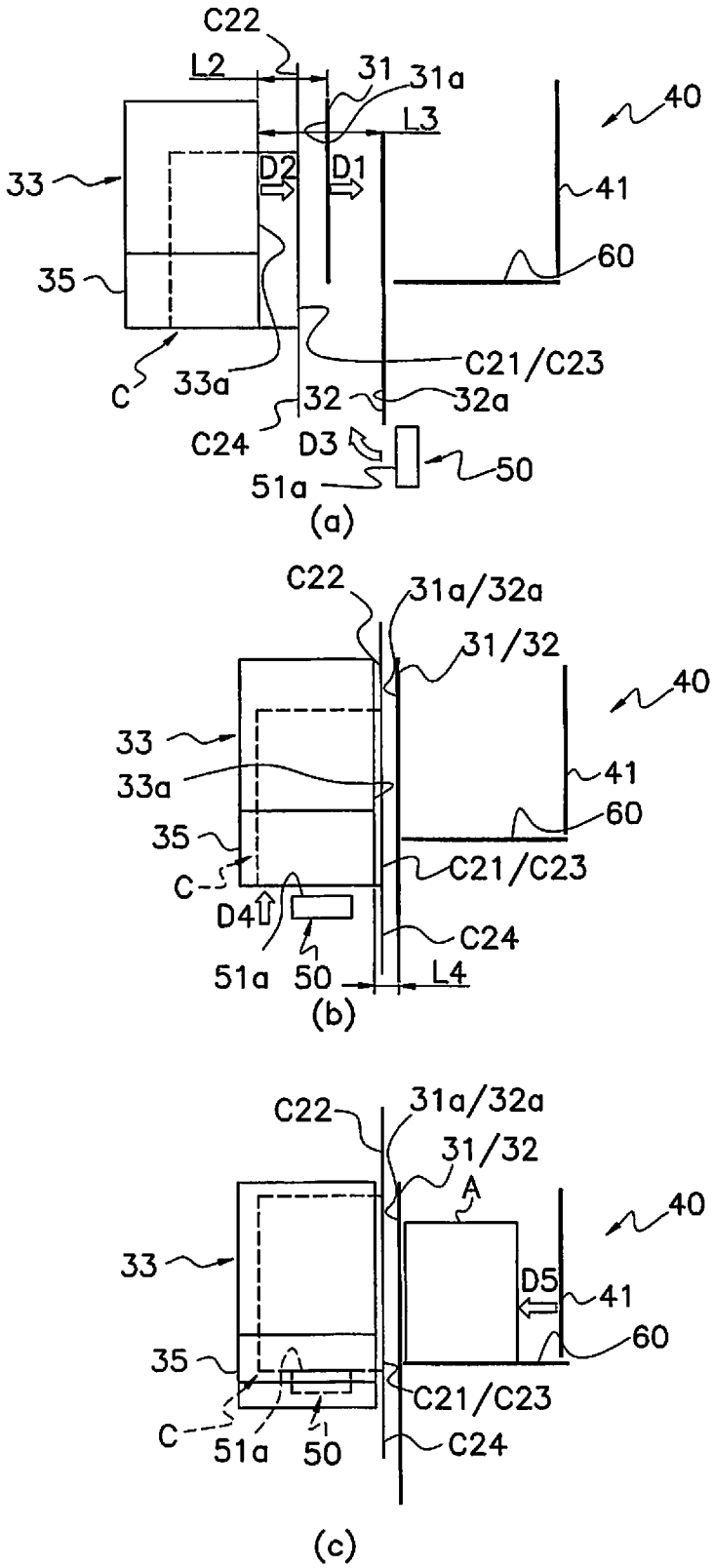
FIG. 8 provides side views, which show the vicinity of the lower guide mechanism viewing from the right side, explaining the movements of the lower guide mechanism of the box packing device of FIG. 1, the pushing part, and the position and orientation changing part.

In the condition in which the article A has been conveyed to the rear side (in FIG. 5) of the pushing member 41 by the article transporting part 60, as indicated by the arrow D5 in FIG. 8(*c*), the pushing member 41 is driven leftward (rearward in FIG. 5) toward the opening of the cardboard box C, and thereby the article A is pushed into the cardboard box C.

The pushing drive unit 42 is controlled by the control device 70 described subsequently. The timing of the operation of the pushing member 41 with the pushing drive unit 42 is described subsequently.

(2-3) Position and Orientation Changing Part

The position and orientation changing part 50 adjusts (changes) the height position of the cardboard box C when the article A is pushed by the pushing part 40. Further the position and orientation changing part 50 raises the cardboard box C which faces its opening forward and into which the article A has been placed, such that the opening faces upward.

The position and orientation changing part 50 has a suction holding plate 51, suction cups 52 (refer FIG. 9), a suction driving unit 53, a vertical driving unit 54, and a rotary driving unit 55 (refer FIG. 3).

The suction holding plate 51 is a plate shaped member, having a holding surface 51*a* that contacts the side face C14 arranged to the lower side of the cardboard box C when the article A is pushed into the cardboard box C. As shown in FIG. 9(*a*), the holding surface 51*a* is provided with a plurality of suction cups 52 that stick to the side face C14. The suction operation of the suction cups 52 is driven by the suction driving unit 53.

The vertical driving unit 54 and the rotary driving unit 55 change the position and orientation of the suction holding plate 51 while the suction cups 52 stick to the side face C14 of the cardboard box C, and thereby change the position and orientation of the cardboard box C.

The rotary driving unit 55 rotates the suction holding plate 51 around a rotational axis extending horizontally in the leftward-rightward direction and changes the orientation of the suction holding plate 51 such that the holding surface 51*a* facing rearward come to face upward or the holding surface 51*a* facing upward come to face rearward.

The vertical driving unit 54 vertically moves the suction holding plate 51 in the state where the holding surface 51*a* faces upward.

The suction driving unit 53, the vertical driving unit 54 and the rotary driving unit 55 are controlled by the control device 70 described subsequently. The timing in which the suction cups 52, driven by the suction driving unit 53, sticks to the side face C14 of the cardboard box C, and the operation and timing of the operation of the suction holding plate 51 with the vertical driving unit 54 and the rotary driving unit 55, are described subsequently.

(2-4) Article Transporting Part

The article transporting part 60 conveys the article A to be packed into the cardboard box C (refer FIG. 8).

The article transporting part 60 is driven by a transport driving unit 61 (refer FIG. 3), to convey the article A at the predetermined speed and timing. Specifically, as described subsequently, the transport driving unit 61 drives the article transporting part 60 so that the article A is conveyed to the rear side of the pushing member 41 of the pushing part 40 (between the pushing member 41 and the opening of the cardboard box C) when the cardboard box C is moved into the predetermined position for packing articles by the first drive unit 37 and the position and orientation changing part 50. The operation of the transport driving unit 61 is controlled by the control device 70 described subsequently.

(2-5) Control Device

The control device 70 is connected to each of the dropping part 20, the pushing part 40, the position and orientation changing part 50 and the article transporting part 60. The control device 70 is also connected to the box making device 2 arranged at a prior stage and the box closing device 3 arranged at a subsequent stage in the box packing device 10. The control device 70 mainly controls various parts of the box packing device 10 and exchange various information with various parts of the box packing device 10

The control device 70 includes a memory unit 71 and a control unit 72 as shown in FIG. 3. The memory unit 71 is comprised primarily of ROM, RAM or a hard disk drive (HDD) or the like. The control unit 72 is comprises primarily of a CPU.

(2-5-1) Memory Unit

Various programs to be executed by the control unit 72 are stored in the memory unit 71. Further, various operating parameters required for the control unit 72 to control the box packing device 10 are stored in the memory unit 71.

(2-5-2) Control Unit

The control unit 72 reads out and executes various programs stored in the memory unit 71, and controls various parts of the box packing device 10, including the dropping part 20, the pushing part 40, the position and orientation changing part 50, the article transporting part 60 and the like.

For example, the control unit 72 controls the first through third drive units 37-39 of the dropping part 20, and thereby causes the second lower guide portions 33, 34, the first lower movable guide portion 31 and the movable hooks 35, 36 to perform the predetermined operation at the predetermined timing.

(3) Operation of the Box Packing Device

The operations of the box packing device 10, from the time of starting of the dropping of the cardboard box C in the dropping part 20 to the time when the opening of the cardboard box C into which the article A has been pushed comes to face upward, will now be described with reference to FIG. 8 through FIG. 11.

(3-1) Arrangement of the Lower Guide Mechanism when the Cardboard Box Drops

Firstly, the arrangements of the first lower movable guide portion 31, the first lower fixed guide portion 32, and the second lower guide portions 33, 34 of the lower guide mechanism 30 when the cardboard box C is in the process of dropping will be described.

Figure 10:
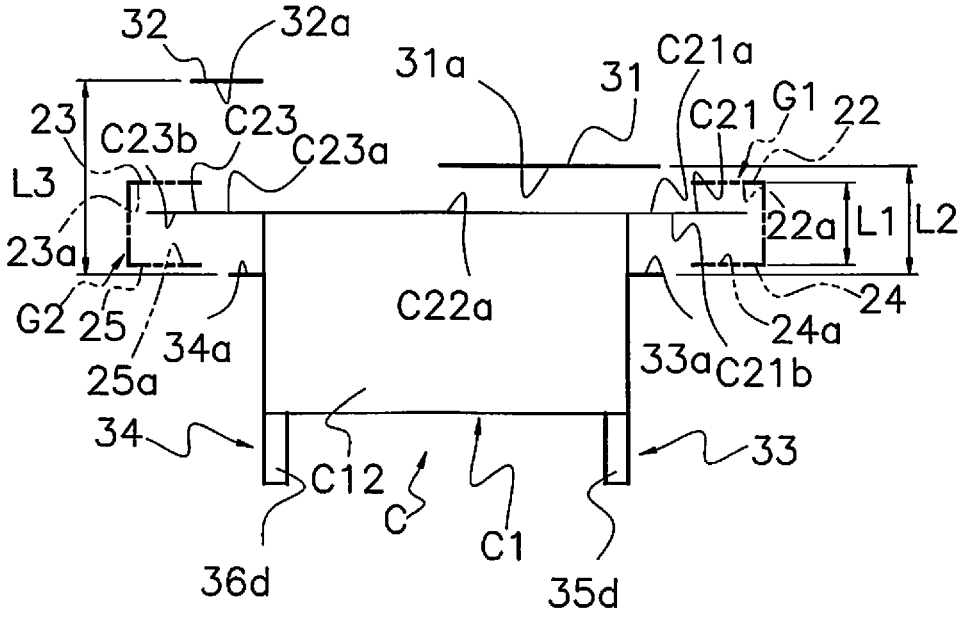
FIG. 10 is a schematic top view explaining the arrangement of the lower guide mechanism of the dropping part in FIG. 5 when the cardboard box drops. The upper guide mechanism is indicated by the two-dot chain line.
Figure 11:
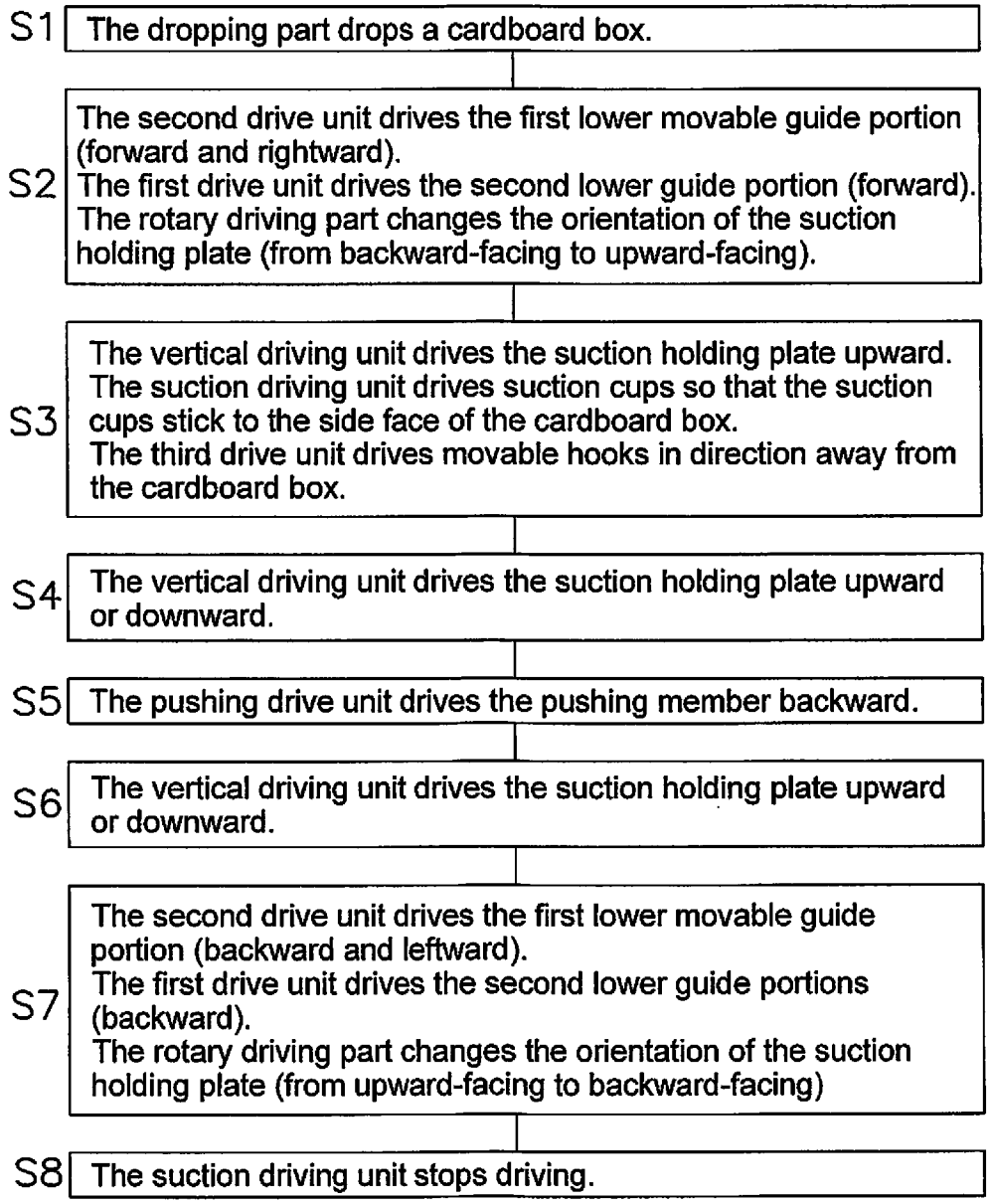
FIG. 11 is a flowchart explaining the operation of the box packing device of FIG. 1.

FIG. 10 shows the arrangement of each member of the lower guide mechanism 30 when the cardboard box C drops, viewed from the above. The arrangement, regarding the forward-rearward direction in FIG. 5, of the first lower movable guide portion 31, the first lower fixed guide portion 32 and the second lower guide portions 33, 34 will now be described using FIG. 10.

In FIG. 10 the right guide portion G1 and the left guide portion G2 of the upper guide mechanism 21 are also shown by the two-dot chain line.

The second lower guide portions 33, 34 are substantially bilateral symmetrically arranged in the top view. That is, the second lower guide portions 33, 34 are arranged such that the guide plane 33*a* of the second lower guide portion 33 and the guide plane 34*a* of the second lower guide portion 34 are disposed substantially on the same plane. The guide planes 33*a*, 34*a* of the second lower guide portions 33, 34 are disposed further rearward in FIG. 5 than the guide planes 24*a*, 25*a* of the second upper guide portions 24, 25.

As shown in FIG. 10, the first lower movable guide portion 31 is arranged to the front side in FIG. 5 of the second lower guide portion 33 such that the minimum distance between the first lower movable guide portion 31 and the second lower guide portion 33, that is, the distance between the guide plane 31*a* of the first lower movable guide portion 31 and the guide plane 33*a* of the second lower guide portion 33, becomes L2. The guide plane 31*a* of the first lower movable guide portion 31 is disposed further forward in FIG. 5 than the guide plane 22*a* of the first upper guide portion 22.

As shown in FIG. 10, the first lower fixed guide portion 32 is arranged to the front side in FIG. 5 of the second lower guide portion 34, such that the minimum distance between the first lower fixed guide portion 32 and the second lower guide portion 34, that is, the distance between the guide plane 32*a* of the first lower fixed guide portion 32 and the guide plane 34*a* of the second lower guide portion 34, is L3. The guide plane 32*a* of the first lower fixed guide portion 32 is arranged further forward in FIG. 5 than the guide plane 23*a* of the first upper guide portion 23.

As shown in FIG. 10, the distances L2 and L3 are greater values than the distance L1 between the guide plane 22*a* of the first upper guide portion 22 and the guide plane 24*a* of the second upper guide portion 24 in the upper guide mechanism 21. Further, the distance L3 is a greater value than the distance L2. Because the distance L2 and the distance L3 are equal to or greater than the distance L1, the cardboard box C are hardly caught by the lower guide mechanism 30 when dropping.

Further, in the top view, the passage through which the flaps C21, C23 pass in the upper guide mechanism 21 (the passage formed between the first upper guide portion 22 and the second upper guide portion 24 and the passage formed between the first upper guide portion 23 and the second upper guide portion 25) is included within the passage through which the flaps C21, C23 pass in the lower guide mechanism 30 (the passage formed between the first lower movable guide portion 31 and the second lower guide portion 33 and the passage formed between the first lower fixed guide portion 32 and the lower guide portion 34). Thus, the flap C21 and the flap C23 having passed through the upper guide mechanism 21, do not run away from the lower guide mechanism 30.

The arrangement, regarding the leftward-rightward direction in FIG. 5, of the first lower movable guide portion 31, the first lower fixed guide portion 32, and the second lower guide portions 33, 34 when the cardboard box C is in the process of dropping will now be described.

FIG. 9(*a*) depicts the vicinity of the lower guide mechanism 30 immediately after the cardboard box C drops. The arrangement of the first lower movable guide portion 31, the first lower fixed guide portion 32, and the second lower guide portions 33, 34 is the same as the arrangement of these while the cardboard box C is dropping. The arrangement, regarding the leftward-rightward direction in FIG. 5, of the first lower movable guide portion 31, the first lower fixed guide portion 32, and the second lower guide portions 33, 34 will now be described using FIG. 9(*a*) and FIG. 10.

As shown in FIG. 9(*a*), the second lower guide portions 33, 34 are substantially bilateral symmetrically arranged in relation to the center of the cardboard box C in the leftward-rightward direction. As shown in FIG. 9(*a*) and FIG. 10, the second lower guide portion 33 opposes the rear face C21*b* of the flap C21 in the vicinity of a boundary between the flap C21 and the side face portion C1. As shown in FIG. 9(*a*) and FIG. 10, the second lower guide portion 34 opposes the rear face C23*b* of the flap C23 in the vicinity of a boundary between the flap C23 and the side face portion C1. Since the second lower guide portions 33, 34 are not driven in the leftward-rightward direction, while the article A is being pushed into the cardboard box C, the second lower guide portion 33 opposes the rear face C2*lb* of the flap C21 in the vicinity of the boundary between the flap C21 and the side face portion C1, and the second lower guide portion 34 opposes the rear face C23*b* of the flap C23 in the vicinity of the boundary between the flap C23 and the side face portion C1.

As shown in FIG. 9(*a*) and FIG. 10, the first lower movable guide portion 31 opposes the center part, in the leftward-rightward direction, of the front face C22*a* of the flap C22 arranged at the upper side. The center part in the leftward-rightward direction here, means the area around the center and does not necessarily include the center in the leftward-rightward direction. As shown in FIG. 9(*a*) and FIG. 10, the first lower movable guide portion 31 extends to the right and opposes the left end part (the vicinity of the boundary between the flap C21 and the side face portion C1) of the front face C22*a* of the flap C21.

As shown in FIG. 9(*a*) and FIG. 10, the first lower fixed guide portion 32 opposes the front face C23*a* of the flap C23 in the vicinity of the boundary between the flap C23 and the side face portion C1. Because the first lower fixed guide portion 32 does not move, while the article A is being pushed into the cardboard box C, the first lower fixed guide portion 32 opposes the front face C23*a* of the flap C23 in the vicinity of the boundary between the flap C23 and the side face portion C1.

The arrangement, regarding the vertical direction in FIG. 5, of the first lower movable guide portion 31, the first lower fixed guide portion 32, and the second lower guide portions 33, 34 when the cardboard box C is in the process of dropping will now be described.

In the vertical direction, the first lower movable guide portion 31, the first lower fixed guide portion 32, and the second lower guide portions 33, 34 are arranged at a height where they oppose the flaps C21 or C23 immediately after the cardboard box C drops (refer FIG. 8(*a*), FIG. 9(*a*)).

(3-2) Operation of the Box Packing Device

The operations of the box packing device 10 will now be described.

In step S1, the cardboard box C drops in the dropping part 20. Specifically, the cardboard box C passes through the upper guide mechanism 21 portion such that the flap C21 passes through the inside of the right guide portion G1 of the upper guide mechanism 21 and the flap C23 passes through the inside of the left guide portion G2 of the upper guide mechanism 21. Further, the cardboard box C drops in the lower guide mechanism 30, such that the flap C21 passes between the first lower movable guide portion 31 and the second lower guide portion 33 and the flap C23 passes between the first lower fixed guide portion 32 and the second lower guide portion 34. The cardboard box C drops onto the protruding portions 35*d*, 36*d* of the movable hooks 35, 36 and is caught by the protruding portions 35*d*, 36*d*. At this point, the cardboard box C has finished dropping.

As movement of the flap C21 and the flap C23 is restricted by the upper guide mechanism 21 and the lower guide mechanism 30, these flaps do not close as the cardboard box C is dropping. Further, since movement of the flap C21 and the flap C23 is restricted to an extent that do not impede the dropping of the cardboard box C, the cardboard box C drops in the predetermined posture and in the predetermined position. Because movement of the flap C22 is restricted by the first lower movable guide portion 31 such that the flap C22 does not fall forward, the flap C22 does not close when the cardboard box C drops.

In step S2, instructed by the control device 70, the second drive unit 38 drives the first lower movable guide portion 31 rightward as indicated by arrow D6 in FIG. 9(*a*). Specifically, the second drive unit 38 drives the first lower movable guide portion 31 into a position opposing only the right end part of the front face C22*a* of the flap C22 as shown in FIG. 9(*b*). At this position, the first lower movable guide portion 31 opposes the front face C21*a* of the flap C21 in the vicinity of the boundary between the flap C21 and the side face portion C1.

As described above, because the first lower movable guide portion 31 is driven into the position opposing only the right end part of the front face C22*a* of the flap C22, the opening of the cardboard box C is scarcely covered by the first lower movable guide portion 31 and is kept wide open. Further, as a part of the first lower movable guide portion 31 opposes the front face C22*a* of the flap C22, the flap C22 is prevented from falling forward.

Moreover, the second drive unit 38 drives the first lower movable guide portion 31 forward as indicated by the arrow D1 in FIG. 8(*a*). More specifically, the second drive unit 38 drives the first lower movable guide portion 31 forward to a position where the guide plane 31*a* of the first lower movable guide portion 31 and the guide plane 32*a* of the first lower fixed guide portion 32 are substantially aligned when viewed from the side (refer FIG. 8(*b*)). When the forward drive of the first lower movable guide portion 31 is completed, the guide plane 31*a* and the guide plane 32*a* are arranged on substantially the same plane.

Further, in step S2, instructed by the control device 70, the first drive unit 37 drives the second lower guide portion 33 forward, as indicated by the arrow D2 in FIG. 8(*a*). Further, the first drive unit 37 also drives the second lower guide portion 34 forward at the same timing and speed. At this time, the guide plane 33*a* of the second lower guide portion 33 comes into contact with the rear face C21*b* of the flap C21 and the guide plane 34*a* of the second lower guide portion 34 comes into contact with the rear face C23*b* of the flap C23, and thereby the cardboard box C is moved forward.

As shown in FIG. 8(*b*), the first drive unit 37 drives the second lower guide portion 33 forward such that the distance between the guide plane 33*a* of the second lower guide portion 33 and the guide plane 31*a* of the first lower movable guide portion 31 becomes L4. Further, the first drive unit 37 drives the second lower guide portion 34 forward such that the distance between the guide plane 34*a* of the second lower guide portion 34 and the guide plane 32*a* of the first lower fixed guide portion 32 becomes L4. A value as close as possible to the thickness of the flap C21 (and the flap C23) is determined as the distance L4, within the scope that the flap C21 is not stuck between the first lower movable guide portion 31 and the second lower guide portion 33 (and the flap C23 is not stuck between the first lower fixed guide portion 32 and the lower guide portion 34) when the cardboard box C is moved vertically in step S4 and step S6 described subsequently.

Moreover, in step S2, instructed by the control device 70, the rotary driving unit 55 rotates the suction holding plate 51 around the rotational axis extending in the leftward-rightward direction as indicated by the arrow D3 in FIG. 8(*a*) and changes the orientation of the suction holding plate 51 such that the holding surface 51*a* facing to the rear side as shown in FIG. 9(*a*) comes to oppose the side face C14 arranged at the bottom of the cardboard box C as shown in FIG. 9(*b*).

In step S3, instructed by the control device 70, the vertical driving unit 54 drives the suction holding plate 51 in the direction of the arrow D4 in FIG. 8(*b*) (upward), such that the holding surface 51*a* of the suction holding plate 51 contacts the side face C14 of the cardboard box C. Further, instructed by the control device 70, the suction cups 52 driven by the suction driving unit 53 sticks to the side face C14 arranged at the bottom of the cardboard box C such that the cardboard box C and the suction cups 52 are connected.

In step S3, instructed by the control device 70, the third drive unit 39 rotationally drives the movable hooks 35, 36 into positions away from the cardboard box C. As shown in FIG. 9(*b*) and FIG. 9(*c*), the third drive unit 39 rotates the movable hook 35 counterclockwise as indicated by arrow D7 in FIG. 9(*b*) and rotates the movable hook 36 clockwise as indicated by arrow D8 in FIG. 9(*b*). Resultantly, the movable hooks 35, 36 enter a state of not being in contact with the cardboard box C as in FIG. 9(*c*).

In step S4, instructed by the control device 70, the vertical driving unit 54 vertically drives the suction holding plate 51 to move the cardboard box C vertically into the position where the article A is pushed into the cardboard box C. At this time, the flap C21 moves in the gap, having the distance L4, between the guide plane 31*a* of the first lower movable guide portion 31 and the guide plane 33*a* of the second lower guide portion 33. The flap C22 moves in the gap, having the distance L4, between the guide plane 32*a* of the first lower fixed guide portion 32 and the guide plane 34*a* of the second lower guide portion 34.

As shown in FIG. 8(*c*), the position where an article is pushed into the cardboard box C is the position substantially adjacent to the article transporting part 60, at which the height of the conveyance surface where the article A is conveyed by the pushing member 41 and the height of the inner face of the side face C14 of the cardboard box C are substantially the same.

In step S5, instructed by the control device 70, the pushing drive unit 42 drives the pushing member 41 rearward in FIG. 5, as indicated by the arrow D5 in FIG. 8(*c*), such that the predetermined quantity of articles A conveyed by the article transporting part 60 are pushed into the cardboard box C. A single article A or a plurality of articles A are pushed into the cardboard box C.

In step S6, instructed by the control device 70, the vertical driving unit 54 vertically drives the suction holding plate 51 mounted with the cardboard box C on the holding surface 51*a*. Specifically, the vertical driving unit 54 vertically moves the suction holding plate 51 into a position at which the orientation of the suction holding plate 51 can be changed by the rotary driving unit 55.

In step S7, instructed by the control device 70, the first drive unit 37 and the second drive unit 38 start operation to drive the second lower guide portions 33, 34 and the first lower movable guide portion 31 in the opposite direction to that in step S2. That is, the first drive unit 37 and the second drive unit 38 return the first lower movable guide portion 31 and the second lower guide portions 33, 34 to their respective positions when the cardboard box C is in the process of dropping (the positions at the time of step S1).

In step S7, instructed by the control device 70, the rotary driving unit 55 starts operation to rotationally drive the suction holding plate 51 in the opposite direction to that of step S2. That is, the rotary driving unit 55 rotates the orientation of the suction holding plate 51 anticlockwise in the right side view in the state where the side face C14 of the cardboard box C is secured by the suction cups 52 such that the upward directed holding surface 51*a* faces toward the rear side. Resultantly, the cardboard box C is placed onto the surface of a conveyor, not shown in the drawing, in the state in which the opening of the cardboard box C faces upward. Note that in this state, the position of the suction holding plate 51 returns to the position when the cardboard box C is in the process of dropping (the position at the time of step S1).

In step S8, instructed by the control device 70, drive of the suction driving unit 53 is stopped, and the suction cups 52 release the side face C14 of the cardboard box C.

The cardboard box C being not secured by the suction cups 52 is conveyed by a conveyor not shown in the drawing toward the box closing device 3.

(4) Characteristics (4-1)

The box packing device 10 according to this embodiment, is provided with the dropping part 20 for dropping the cardboard box C used for packing to change the height position of the cardboard box C. The cardboard box C has the rectangular shaped side face portion C1 having the four side faces C11-C14 and the four flaps C21-C24, as tabular lid portions, extending respectively from the four side faces C11-C14. The dropping part 20 positions the side face C14 of the four side faces C11-C14 to the bottom and drops the cardboard box C in the state that the flap C22, as the upper lid portion, extending from the upper side face C12 among the four flaps C21-C24 and the flaps C21 and C23, as the first and second lateral lid portions, extending from the lateral side faces C11 and C13 among the four flaps C21-C24 are opened outward. The dropping part 20 has the upper guide mechanism 21 and the lower guide mechanism 30 arranged below the upper guide mechanism 21.

The upper guide mechanism 21 includes the first upper guide portions 22, 23, as the first guide portion, arranged so as to oppose the front faces C21*a*, C23*a* of the flaps C21 and C23 when the cardboard box C drops and the second upper guide portions 24, 25, as the second guide portion, arranged so as to oppose the rear faces C21*b*, C23*b* of the flaps C21, C23 when the cardboard box C drops. The lower guide mechanism 30 includes the first lower movable guide portion 31 and the first lower fixed guide portion 32, as the third guide portion, arranged so as to oppose the front faces C21*a*, C23*a* of the flaps C21, C23 when the cardboard box C drops and after the cardboard box C drops, the second lower guide portions 33, 34, as the fourth guide portion, arranged so as to oppose the rear faces C21*b*, C23*b* of the flaps C21, C23 when the cardboard box C drops and after the cardboard box C drops, and the first drive unit 37 for driving the second lower guide portions 33, 34 toward the first lower movable guide portion 31 and the first lower fixed guide portion 32 after the cardboard box C drops.

Here, since it is possible to alter the distance between the first lower movable guide portion 31 and the first lower fixed guide portion 32, as the third guide portions, and the second lower guide portions 33, 34, as the fourth guide portions, the passage through which the flaps C21, C23 pass can be kept wide open until the cardboard box C drops, and after the cardboard box C drops, movement of the flaps C21, C23 can be highly restricted such that the cardboard box C is kept in the appropriate posture and position. Resultantly, a highly reliable box packing device 10 can be provided.

(4-2)

In the box packing device 10 according to this embodiment, the first lower movable guide portion 31 and the first lower fixed guide portion 32, and the second lower guide portions 33, 34 are arranged such that, when the cardboard box C drops, the minimum distance between the first lower movable guide portion 31 and the second lower guide portion 33 and the minimum distance between the first lower fixed guide portion 32 and the second lower guide portion 34 are equal to or greater than the minimum distance between the first upper guide portion 22 and the second upper guide portion 24 (the minimum distance between the first upper guide portion 23 and the second upper guide portion 24). In other words, the first lower movable guide portion 31 and the first lower fixed guide portion 32, and the second lower guide portions 33, 34, are arranged such that, when the cardboard box C drops, the distance L2 between the guide plane 31*a* of the first lower movable guide portion 31 and the guide plane 33*a* of the second lower guide portion 33 and the distance L3 between the guide plane 32*a* of the first lower fixed guide portion 32 and the guide plane 34*a* of the second lower guide portion 34 are equal to or greater than the distance L1 between the guide plane 22*a* of the first upper guide portion 22 and the guide plane 24*a* of the second upper guide portion 24 (the distance L1 between the guide plane 23*a* of the first upper guide portion 23 and the guide plane 25*a* of the second upper guide portion 25).

Here, since the passage for the flaps C21, C23 in the lower guide mechanism 30 is kept wide open until the box has dropped, the cardboard box C is hardly caught by the lower guide mechanism 30. Thus, a highly reliable box packing device 10 can be provided.

Further, in the box packing device 10 according to this embodiment, the first lower movable guide portion 31, as the third guide portion, is arranged further forward than the first upper guide portion 22, and the first lower fixed guide portion 32, as the third guide portion, is arranged further forward than the first upper guide portion 23. The second lower guide portion 33, as the fourth guide portion, is arranged further rearward than the second upper guide portion 24, and the second lower guide portion 34, as the fourth guide portion, is arranged further rearward than the second upper guide portion 25.

That is, in the top view, the passage through which the flaps C21, C23 pass in the upper guide mechanism 21 (the passage formed between the first upper guide portion 22 and the second upper guide portion 24 and the passage formed between the first upper guide portion 23 and the second upper guide portion 25) is included within the passage through which the flaps C21, C23 pass in the lower guide mechanism 30 (the passage formed between the first lower movable guide portion 31 and the second lower guide portion 33 and the passage formed between the first lower fixed guide portion 32 and the lower guide portion 34).

Thus, the flap C21 and the flap C23 having passed through the upper guide mechanism 21, do not run away from the lower guide mechanism 30.

(4-3)

In this box packing device 10 according to this embodiment, the upper guide mechanism 21 includes the first upper guide portions 22, 23 having the guide planes 22*a*, 23*a* that oppose the front faces C21*a*, C23*a* of the flaps C21, C23 when the cardboard box C drops and the second upper guide portions 24, 25 having the guide planes 24*a*, 25*a* that oppose the rear faces C21*b*, C23*b* of the flaps C21, C23 when the cardboard box C drops. The lower guide mechanism 30 includes the first lower movable guide portion 31 and the first lower fixed guide portion 32 having the guide planes 31*a*, 32*a* that oppose the front faces C21*a*, C23*a* of the flaps C21, C23 when the cardboard box C drops and after the cardboard box C drops and the second lower guide portions 33, 34 having the guide planes 33*a*, 34*a* that oppose the rear faces C21*b*, C23*b* of the flaps C21, C23 when the cardboard box C drops and after the cardboard box C drops.

Here, since the front faces C21*a*, C23*a* and the rear faces C21*b*, C23*b* of the flaps C21, C23 are guided by the planes in the upper guide mechanism 21 and the lower guide mechanism 30, movement of the flaps C21, C23 can be highly restricted. Resultantly, the cardboard box C can be held in the appropriate posture and position, and the highly reliable box packing device 10 can be provided.

(4-4)

In this box packing device 10 according to this embodiment, at the point in time when the first drive unit 37 completes driving (the point in time when the first drive unit 37 has moved the second lower guide portions 33, 34 closest toward the first lower movable guide portion 31 and the first lower fixed guide portion 32 respectively), the first lower movable guide portion 31 and the first lower fixed guide portion 32 oppose the front faces C21*a*, C23*a* of the flaps C21, C23 in the vicinity of the boundary between the flaps C21, C23 and the side face portion C1. Moreover, at the point in time when the first drive unit 37 completes driving, the second lower guide portions 33, 34 oppose the rear faces C21*b*, C23*b* of the flaps C21, C23 in the vicinity of the boundary between the flaps C21, C23 and the side face portion C1.

Here, since the first lower movable guide portion 31 and the first lower fixed guide portion 32, and the second lower guide portions 33, 34 restrict movement of the flaps C21, C23 in the vicinity of the boundary of the side face portion C1 and the flaps C21, C23 (in the area at the base of the flaps C21, C23), movement of the cardboard box C can be more stringently restricted in comparison to the case that movement of the flaps C21, C23 is restricted at the end parts of the flaps C21, C23.

(4-5)

In the box packing device 10 according to this embodiment, the first lower movable guide portion 31, as the third guide portion, opposes the front face C22*a* of the flap C22 as the upper lid portion.

In this way the flap C22 is prevented from falling forward and closing the opening of the cardboard box C.

(4-6)

The box packing device 10 according to this embodiment has the first lower fixed guide portion 32 that opposes the front face C23*a* of the flap C23 and the first lower movable guide portion 31 that opposes the front face C21*a* of the flap C21 and the front face C22*a* of the flap C22 as the third guide portion. The first lower movable guide portion 31 opposes the center part of the front face C22*a* of the flap C22 when the cardboard box C drops. The lower guide mechanism 30 includes the second drive unit 38 for driving the first lower movable guide portion 31 substantially in parallel to the front face C22*a* of the flap C22 after the cardboard box C drops. The second drive unit 38 drives the first lower movable guide portion 31 to the position where the first lower movable guide portion 31 opposes the front face C22*a* of the flap C22 only at the end part of the flap C22 after the cardboard box C drops.

Here, the first lower movable guide portion 31 is arranged forward of the flap C21, and opposes the center part of the front face C22*a* of the flap C22 when the cardboard box C drops, and opposes only the end part of the front face C22*a* of the flap C22 after the cardboard box C drops. Accordingly, the first lower movable guide portion 31 can easily be prevent that the flap C22 falls forward when the cardboard box C drops. On the other hand, after the cardboard box C drops, the opening of the cardboard box C can be kept open wide while the first lower movable guide portion 31 prevents the flap C22 from falling forward.

(4-7)

In the box packing device 10 according to this embodiment, the first drive unit 37 drives the second lower guide portions 33, 34 so that the second lower guide portions 33, 34 come into contact with the flaps C21, C23 and thereby to move the cardboard box C horizontally.

In this way, the cardboard box C can be moved horizontally to the desired position by the first drive unit 37.

(5) Modifications

Various modifications of the above described embodiment will now be described. A plurality of modifications may be combined as appropriate.

(5-1) Modification A

In the above described embodiment, the first drive unit 37 drives the second lower guide portions 33, 34, being the fourth guide portion, so as to approach the first lower movable guide portion 31 and the first lower fixed guide portion 32, being the third guide portions, but this is illustrative and not restrictive.

For example, the third guide portion may be driven toward the fourth guide portion to narrow the width of the gap between the third guide portion and the fourth guide portion in which the flaps C21 and C23 can move. Again, the third guide portions and the fourth guide portions may be mutually driven toward each other.

Note that the relationship between the position where the cardboard box C drops and the position for pushing in the article A with the pushing part 40 are considered to decide how the third guide portions and the fourth guide portions are driven.

(5-2) Modification B

In the above described embodiment, both the first upper guide portions 22, 23 as the first guide portion and the second upper guide portions 24, 25 as the second guide portions have guide planes (22*a*, 23*a*, 24*a*, 25*a*), but this is illustrative and not restrictive. For example, only the first upper guide portions 22, 23 may have the guide planes 22*a*, 23*a*, and the second upper guide portions 24, 25 may be rod shaped members. Alternatively, the second upper guide portions 24, 25 may have the guide planes 24*a*, 25*a*, and the first upper guide portions 22, 23 may be rod shaped members. The same applies with respect to the first lower movable guide portion 31 and the first lower fixed guide portion 32 as the third guide portion, and the second lower guide portions 33, 34 as the fourth guide portion.

In order to stringently restrict movement of the flaps C21, C23 of the cardboard box C, it is preferable that both faces of the flaps C21, C23 (front faces C21*a*, C23*a* and rear faces C21*b*, C23*b*) of the cardboard box C oppose guide planes.

(5-3) Modification C

In the above described embodiment, the first lower movable guide portion 31 of the flap C21 side, being the third guide portion, is driven, but this is illustrative and not restrictive. The third guide portion on the flap C23 side may be driven.

(5-4) Modification D

In the above described embodiment, the article A is pushed into each cardboard box C by the pushing member 41 only once, but this is illustrative and not restrictive. The article A may be pushed into the cardboard box C in multiple stages as the height position of the cardboard box C is being changed by the position and orientation changing part 50.

INDUSTRIAL APPLICABILITY

As described above, the box packing device according to the present invention moves downward a horizontally opened cardboard box by dropping it and is useful as a highly reliable box packing device which can drop the cardboard box without obstacle while maintaining the cardboard box in the appropriate posture after the box has dropped.

REFERENCE SIGNS LIST

10 Box packing device
20 Dropping part
21 Upper guide mechanism
22, 23 First upper guide portion (First guide portion)
22 *a*, 23 *a* Guide plane (First guide plane)
24, 25 Second upper guide portion (Second guide portion)
24*a*, 25*a* Guide plane (Second guide plane)
30 Lower guide mechanism
31 First lower movable guide portion (Movable guide portion of the third guide portion)
31 *a* Guide plane (Third guide plane)
32 First lower fixed guide portion (Fixed guide portion of the third guide portion)
32 *a* Guide plane (Third guide plane)
33, 34 Second lower guide portion (Fourth guide portion)
33*a*, 34*a* Guide plane (Fourth guide plane)
37 First drive unit
38 Second drive unit
C Cardboard box (box)
C1 Side face portion
C11-C14 Side face
C2 Flap (Lid portion)
C21 Flap (Second lateral lid portion)
C21*a* Front face (Front face of second lateral lid portion)
C21*b* Rear face (Rear face of second lateral lid portion)
C22 Flap (Upper lid portion)
C22*a* Front face (Front face of upper lid portion)
C23 Flap (First lateral lid portion)
C23*a* Front face (Front face of first lateral lid portion)
C23*b* Rear face (Rear face of the first lateral lid portion)
L1 Distance between the guide plane of the first upper guide portion and the guide plane of the second upper guide portion (Minimum distance between the first guide portion and the second guide portion)
L2 Distance between the guide plane of the first lower movable guide portion and the guide plane of the second lower guide portion (Minimum distance between the third guide portion and the fourth guide portion when the cardboard box drops)
L3 Distance between the guide plane of the first lower fixed guide portion and the guide plane of the second lower guide portion (Minimum distance between the third guide portion and the fourth guide portion when the cardboard box drops)

The invention claimed is:

1. A box packing device comprising:

a dropping part having an upper guide mechanism and a lower guide mechanism which is arranged below the upper guide mechanism, the dropping part being configured to drop a box, the box having four side faces that define a side face portion, each of the four side faces having a corresponding tabular lid portion extending therefrom, one of the four side faces is directed downward and an upper lid portion extending from an upper side face among the four tabular lid portions and a first lateral lid portion and a second lateral lid portion extending from laterally positioned side faces among the four tabular lid portions are opened outward as the height position of the box is changed: and a first drive unit, wherein the upper guide mechanism includes a first guide portion arranged so as to oppose front faces of the first and second lateral lid portions when the box is dropped, and a second guide portion arranged so as to oppose rear faces of the first and second lateral lid portions when the box is dropped, and the lower guide mechanism includes a third guide portion arranged so as to oppose the front faces of the first and second lateral lid portions when the box is dropped and after the box is dropped, a fourth guide portion arranged so as to oppose the rear faces of the first and second lateral lid portions when the box is dropped and after the box is dropped, and the first drive unit drives at least one of the third guide portion and the fourth guide portion toward the other of the third guide portion and the fourth guide portion after the box is dropped.

2. The box packing device according to claim 1, wherein the third guide portion and the fourth guide portion are arranged such that, when the box is dropped, a minimum distance between the third guide portion and the fourth guide portion is equal to or greater than a minimum distance between the first guide portion and the second guide portion.

3. The box packing device according to claim 2, wherein the upper guide mechanism includes at least either of the first guide portion having a first guide plane that opposes the front faces of the first and second lateral lid portions when the box is dropped, or the second guide portion having a second guide plane that opposes the rear faces of the first and second lateral lid portions when the box is dropped, and the lower guide mechanism includes at least either of the third guide portion having a third guide plane that opposes the front faces of the first and second lateral lid portions when the box is dropped and after the box is dropped or the fourth guide portion having a fourth guide plane that opposes the rear faces of the first and second lateral lid portions when the box is dropped and after the box is dropped.

4. The box packing device according claim 3, wherein at the point in time when the first drive unit completes driving, the third guide portion opposes the front faces of the first and second lateral lid portions in the vicinity of a boundary between the first and second lateral lid portions and the side face portion and the fourth guide portions opposes the rear faces of the first and second lateral lid portions in the vicinity of a boundary between the first and second lateral lid portions and the side face portion.

5. The box packing device according to claim 3, wherein the third guide portion further opposes a front face of the upper lid portion.

6. The box packing device according to claim 5, wherein the third guide portion includes a fixed guide portion that opposes the front face of the first lateral lid portion and a movable guide portion that opposes the front face of the second lateral lid portion and the front face of the upper lid portion, the movable guide portion opposes at least a center part of the front face of the upper lid portion when the box is dropped, the lower guide mechanism further includes a second drive unit for driving the movable guide portion in parallel to the front face of the upper lid portion after the box is dropped, and the second drive unit drives the movable guide portion to a position where the movable guide portion opposes the front face of the upper lid portion only at an end part of the second lateral lid portion after the box is dropped.

7. The box packing device according to claim 3, wherein the first drive unit drives at least either of the third guide portion or the fourth guide portion so that at least either of the third guide portion or the fourth guide portion come into contact with the first and second lateral lid portions thereby to move the box horizontally.

8. The box packing device according to claim 1, wherein the upper guide mechanism includes at least either of the first guide portion having a first guide plane that opposes the front faces of the first and second lateral lid portions when the box is dropped, or the second guide portions having a second guide plane that opposes the rear faces of the first and second lateral lid portions when the box is dropped, and the lower guide mechanism includes at least either of the third guide portion having a third guide plane that opposes the front faces of the first and second lateral lid portions when the box is dropped and after the box is dropped or the fourth guide portion having a fourth guide plane that opposes the rear faces of the first and second lateral lid portions when the box is dropped and after the box is dropped.

9. The box packing device according to claim 1, wherein at the point in time when the first drive unit completes driving, the third guide portion opposes the front faces of the first and second lateral lid portions in the vicinity of a boundary between the first and second lateral lid portions and the side face portion and the fourth guide portions opposes the rear faces of the first and second lateral lid portions in the vicinity of a boundary between the first and second lateral lid portions and the side face portion.

10. The box packing device according to claim 1, wherein the third guide portion further opposes a front face of the upper lid portion.

11. The box packing device according to claim 10, wherein the third guide portion includes a fixed guide portion that opposes the front face of the first lateral lid portion and a movable guide portion that opposes the front face of the second lateral lid portion and the front face of the upper lid portion, the movable guide portion opposes at least a center part of the front face of the upper lid portion when the box is dropped, the lower guide mechanism further includes a second drive unit for driving the movable guide portion in parallel to the front face of the upper lid portion after the box is dropped, and the second drive unit drives the movable guide portion to a position where the movable guide portion opposes the front face of the upper lid portion only at an end part of the second lateral lid portion after the box is dropped.

12. The box packing device according to claim 1, wherein the first drive unit drives at least either of the third guide portion or the fourth guide portion so that at least either of the third guide portion or the fourth guide portion come into contact with the first and second lateral lid portions thereby to move the box horizontally.

* * * * *